United States Patent [19]

Fleischmann et al.

[11] 4,073,702

[45] Feb. 14, 1978

[54] ELECTROCHEMICAL CELLS

[75] Inventors: Martin Fleischmann, Eastleigh; Francis Goodridge, Newcastle-upon-Tyne; Christopher John Vance, Jarrow, all of England

[73] Assignee: National Research Development Corporation, London, England

[21] Appl. No.: 731,374

[22] Filed: Oct. 12, 1976

[30] Foreign Application Priority Data

Oct. 10, 1975 United Kingdom ..... 41622/75

[51] Int. Cl.[2] ..... C25C 1/00; C25C 1/12; C25C 7/06; C25C 7/02

[52] U.S. Cl. ..... 204/59 R; 204/105 R; 204/222; 204/290 R; 204/290 F; 204/294

[58] Field of Search ..... 204/222, 223, 106, 290 R, 204/290 F, 152, 105 R, DIG. 10, 59 R, 294

[56] References Cited

U.S. PATENT DOCUMENTS

| | | | |
|---|---|---|---|
| 3,616,356 | 10/1971 | Roy | 204/152 |
| 3,654,098 | 4/1972 | Backhurst et al. | 204/222 X |
| 3,699,014 | 10/1972 | Eisner | 204/DIG. 10 |

OTHER PUBLICATIONS

Le Goff et al., "Applications of Fluidized Beds in Electrochemistry," Industrial and Engineering Chemistry, vol. 61, #10, Oct. 1969, pp. 8–17.

*Primary Examiner*—John H. Mack
*Assistant Examiner*—D. R. Valentine
*Attorney, Agent, or Firm*—Carroll F. Palmer

[57] ABSTRACT

The invention relates to electrochemical cells whereof one electrode is of a particulate type which may comprise a fluidized bed electrode, a packed bed electrode or a circulating bed electrode, an electrolyte being passed through the particulate electrode possibly for fluidizing and/or circulating the particles of the electrode. Whereas in previous cells of this kind a diaphragm has been arranged between the particulate electrode and the counterelectrode of the cell, it has been discovered that such a cell can be operated with the counterelectrode actually in contact with particles of the particulate electrode provided the material of the surface of the counterelectrode is suitably chosen. Among the materials mentioned are graphite, ruthenium oxide, lead oxide and iron oxide.

11 Claims, 1 Drawing Figure

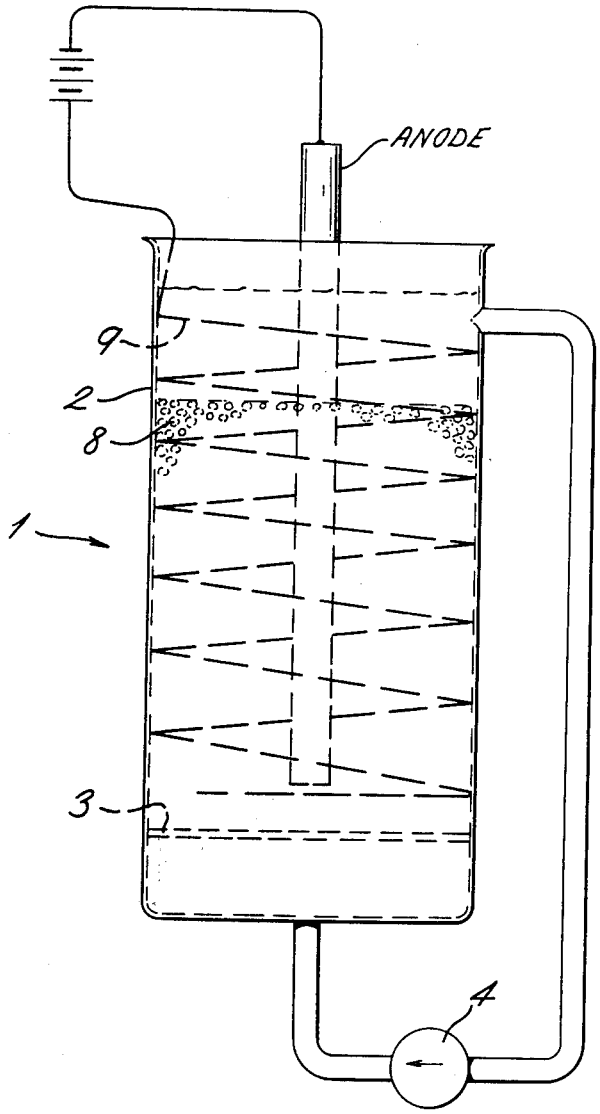
ANODE
9
2
8
1
3
4

ELECTROCHEMICAL CELLS

This invention relates to electrochemical cells and concerns more particularly those cells in which one of the electrodes, usually the cathode, is of the type comprising a mass of particulate material, at least the surfaces of some at least of the particles being electronically conductive, electrolyte in operation of the cell being passed through the cell. Thus the particles may be in the form of a packed bed or the flow of electrolyte may be such as possibly to expand the mass of particles into a fluidized bed or even to entrain particles to form a circulating type of bed; feeder members will be provided to conduct current to or from the particles in the cell. In such fluidized bed electrode cells as have previously been proposed it has been assumed that the anode should be separated from the cathode material by an ion permeable or semi-permeable membrane for the reason that, if the anode member were to be inserted into the particle-containing electrolyte then there would be electrical shorting between the two electrodes.

It has now been discovered that there is no shorting or at least no apparent shorting if the cathode particles do make contact with the anode member provided that the anode surface is suitable.

In accordance with the invention, an electrochemical cell comprises one electrode of a particulate type as hereinbefore defined, means for passing an electrolyte through said particulate electrode and a counterelectrode in direct contact with at least some particles of said particulate electrode, the material of the surface at least of the counterelectrode being definable as one which is electrically conducting but the contact resistance in air between a surface of the material and the superficial area of a copper test surface being at least about 10 times the contact resistance under the same conditions of measurement between the said area of the test surface and another surface of copper.

In practice, it will probably be quite evident to those skilled in the art which anode surfaces are likely to meet the said definition. In case of doubt, it is possible to conduct a very simple test to determine the suitability of a material.

Thus a piece of copper presenting a flat face of approximately 1 $mm^2$ can be mounted on a bar which is weighted to balance about a fulcrum and a piece of material, of which it is wished to determine the suitability, is arranged so that the copper test surface is in contact with the surface thereof. A nominal mass, of, say, 3 grams, is placed on top of the copper test piece so that the test piece should exert a given pressure on the surface under investigation. The currents which pass when voltages of differing values are applied across the contact are measured for each voltage and values of the contact resistance are determined from these values thus giving an average value. A similar test is made with the copper test piece in contact with a piece of copper under substantially the same conditions as in the previous test and the average value of the copper-to-copper contact resistance is obtained. It will be appreciated that only a comparatively simple test equipment is required and that there will probably be a maximum voltage which should be applied for the test and that such voltage should probably be only of the order of that in use in the electrochemical cell, say of the order of 1 volt or less. This and other points regarding a comparative test of this nature will also be apparent to those skilled in the art.

An alternative test may require only a copper wire of which the end may be allowed to rest against the surface to be tested so long as it is possible to reproduce substantially the same conditions for the comparative test with a copper surface. Such a test will obviously be cruder than the first test arrangement but it will probably suffice in many, if not all, cases.

For example, using the two methods with surfaces of commercial graphite, ruthenium oxide, lead oxide, the following results were obtained for certain materials, the applied voltage being in millivolts, and the observed current in milliamperes, the resistance being in ohms.

| | Test 1 | | | Test 2 | | |
|---|---|---|---|---|---|---|
| Material | mV | mA | Resistance | mV | mA | Resistance |
| | 215 | 80 | 2.7 | 180 | 97 | 1.86 |
| Commercial | 510 | 160 | 3.2 | 390 | 190 | 2.01 |
| Graphite | 730 | 250 | 2.9 | 680 | 400 | 1.70 |
| | 1.070 | 360 | 3.4 | 1000 | 700 | 1.45 |
| | | | | 1200 | 950 | 1.25 |
| | Average resistance | | 3.0 ohms. | Average resistance | | 1.65 ohms |
| | 200 | 38 | 5.26 | 75 | 11 | 6.8 |
| Ruthenium | 500 | 90 | 5.55 | 186 | 25 | 7.44 |
| oxide coated | 650 | 123 | 5.28 | 302 | 46 | 6.6 |
| on Titanium | 1000 | 190 | 5.26 | 504 | 98 | 5.2 |
| (D.S.A.) | 1200 | 240 | 5.00 | 1400 | 300 | 4.7 |
| | Average resistance | | 5.27 ohms | 1940 | 550 | 3.5 |
| | | | | Average resistance | | 6.85 ohms |
| | 250 | 17 | 14.7 | 380 | 30 | 12.7 |
| Lead dioxide | 380 | 27 | 14.0 | 800 | 52 | 15.4 |
| Test 1 on | 450 | 23 | 19.6 | 1800 | 130 | 13.8 |
| steel | | | | | | |
| Test 2 on | 780 | 44 | 17.7 | 2200 | 200 | 11.0 |
| lead | 1.120 | 71 | 15.8 | Average resistance | | 3.2 ohms |
| | Average resistance | | 16.4 ohms | | | |
| | 370 | 240 | 1.54 | | | |
| | 480 | 340 | 1.40 | | | |
| Iron oxide | | | | | | |
| | 600 | 440 | 1.40 | | | |
| | 830 | 700 | 1.20 | | | |
| | Average resistance | | 1.38 ohms | | | |
| | 4.0 | 70 | 0.06 | 3 | 27.3 | 0.11 |
| | 11.5 | 195 | 0.06 | 20 | 222 | 0.09 |

-continued

| Material | Test 1 mV | Test 1 mA | Test 1 Resistance | Test 2 mV | Test 2 mA | Test 2 Resistance |
|---|---|---|---|---|---|---|
| Copper | 17.0 | 295 | 0.06 | 55 | 546 | 0.10 |
| | 28.0 | 520 | 0.055 | 89 | 742 | 0.12 |
| | 41.5 | 790 | 0.053 | 145 | 1320 | 0.11 |
| | Average resistance | | 0.058 ohms | 174 | 1660 | 0.105 |
| | | | | Average resistance | | 0.106 ohms |
| | 5.5 | 60 | .09 | 2.5 | 17 | 0.153 |
| | 15.5 | 150 | .10 | 23 | 140 | 0.163 |
| Lead | 27 | 240 | .11 | 44 | 247 | 0.180 |
| | 38.5 | 333 | .115 | 67 | 370 | 0.180 |
| | 53 | 463 | .115 | 89 | 480 | 0.185 |
| | 76 | 615 | .12 | Average resistance | | 0.172 ohms |
| | Average resistance | | .125 ohms | | | |

According to the above tests, therefore, a copper surface yielded a contact resistance averaging 0.058 ohms by the one test and 0.106 ohms by the more simple test and all the other surfaces tested other than lead gave contact resistances average at least 10 times the equivalent resistance of copper in the respective tests. Each of these, materials other than copper and lead, should, therefore, be suitable for use as a counterelectrode in contact with the particles of a particulate electrode.

Other examples of materials suitable for use as a counterelectrode without causing short-circuiting of the cell when placed in a particulate bed electrode are many and if it is not desired to use any of the materials given by way of example, it will be possible to confirm the selection, if necessary, by the above tests.

Certain materials, otherwise usable, may be difficult to prepare. Thus, coatings may not be able to withstand the conditions in a particular cell and, although the cell may operate for a short while, the coating may be removed by the electrolyte. However, such situations will be met as they arise and better methods of coating may be evolved if it is desired to pursue the particular material in the respect of use in accordance with the invention. For example, if an electrode material operates for a reasonable time before failing due to removal under the conditions in the cell, then it is possible that an electrode of acceptable life could be provided by arranging for greater thickness of the surface material.

It is possible that some counterelectrode materials will be satisfactory for certain cell reactions while not being satisfactory for other reactions. This will, of course, be evident to the operator skilled in the art.

For a more complete understanding of the invention reference is made to the accompanying drawing in which the FIGURE is a side elevational view of an electrochemical cell in accordance with the invention.

With reference to the FIGURE, the cell 1 comprises a cylindrical glass container 2 having an internal diameter of 2 cm. A glass frit plate 3 extends horizontally across the container 2 for distributing electrolyte flow from pump 4 evenly over the cross-section of the tube 2. The cathode 8 consists of a mass of solid copper beads of approximately 500 $\mu$m diameter providing a settled depth of about 2 cm. on the frit plate 3. A copper wire spiral 9 along the inner wall of the container 2 serves as a current feeder to the cathode.

Using an electrochemical cell as just shown and described, the following tests were made:

I. Using an electrolyte composition of 2.2 grams per liter of copper in aqueous solution with 16 grams per liter of sulphuric acid, an anode comprising a bar of lead coated with lead dioxide and exposing an area of about 3 sq.cm. to the electrolyte was extended into the electrolyte from the top of the cell nearly to touch the frit, in consequence the anode was in direct contact with the copper beads of the cathode.

With the cathode fluidized to expand by about 30% the voltage variation between anode and cathode with change of current is indicated in Table I.

TABLE I

| | | | | | | |
|---|---|---|---|---|---|---|
| Current amps | 0.0 | 0.1 | 0.2 | 0.3 | 0.4 | 0.5 |
| Feeder-Anode Voltage/volts | 1.3 | 1.9 | 2.2 | 2.4 | 2.6 | 2.8 |

Copious gas could be seen evolving from the region near the anode and, by the change of color of the copper particles, copper was being deposited.

II. With no copper beads present but using the same anode, in conjunction with the same cathode feeder, the results are shown in Table II.

TABLE II

| | | | | | |
|---|---|---|---|---|---|
| Current amps | 0.2 | 0.1 | 0.3 | 0.4 | 0.5 |
| Feeder-Anode Voltage/volts | 1.3 | 2.9 | 3.6 | 3.8 | 4.1 |

III. Copper beads were present as in Test 1 but there was little or no expansion of the bed which was, therefore, behaving as a, so-called, packed bed. In this test there was no observable current flow when the voltage between the cathode feeder and the same anode as used in the previous two tests was 1.2 volts. At 1.8 volts the current flow was 0.1 amp. and slight gas evolution was seen to be taking place near the anode. The current rose to 0.5 amp. at an applied voltage of 2.3 volts and copious gas was evolved near the anode.

This test indicates that for this particular system, even with a packed bed of particles, there is no direct shorting between the electrodes.

IV. Using in place of the lead dioxide anode as in Test I, an anode of the type known as D.S.A. supplied by De Nora Limited and of immersed area of about 2 sq.cm., with no particles present, the following results were obtained:

| | | | | | | | |
|---|---|---|---|---|---|---|---|
| Current amps | 0 | 0.1 | 0.2 | 0.3 | 0.4 | 0.5 | 0.6 |
| Feeder-Anode Voltage/volts | 0.2 | 2.6 | 2.9 | 3.3 | 3.6 | 3.9 | 4.3 |

V. As for test IV but with the copper beads present and in the form of a fluidized bed the following cell performance occurred:

| Current amps | 0 | 0.1 | 0.2 | 0.3 | 0.4 | 0.5 | 0.6 |
|---|---|---|---|---|---|---|---|
| Feeder-Anode Voltage/volts | 0.09 | 1.6 | 2.0 | 2.4 | 2.9 | 3.1 | 3.5 |

In this test, gas evolution was noted to commence from the region near the anode when the applied voltage had reached 2.0 volts and for the higher voltages, gas evolution was greater.

VI. Using the D.S.A. anode inserted into the mass of copper beads in settled form of a packed bed the following results were noted:

| Current amps | 0 | 2.5 | 3 | 3.5 |
|---|---|---|---|---|
| Feeder-Anode Voltage/volts | 0.005 | 1.1 | 1.01 | 1.2 |

No gas evolution was noted near the anode in this test but it was noted that if the electrolyte flow was increased to the extent that incipient fluidization of the copper beads occurred, then gassing near the anode commences and the current fluctuates widely. With the particles in settled state only electronic conduction occurs in view of the absence of gas evolution.

VII. Using a stainless steel rod anode in the same cell after the stainless steel rod had been anodised in the copper sulphate/sulphuric acid electrolyte for a few minutes and then dipped into the fluidized bed, the feeder-anode voltage fell to zero probably showing that the oxide film on the rod was not sufficient a coating. However, the performance of a cell with such anode surface can be improved by improvement of the oxidation of the steel rod.

VIII. When an untreated lead anode was dipped into the fluidised bed of the cell as used for the previous tests, the feeder-anode voltage was zero as would be expected.

IX. Using a similar cell as for the previous tests but with an electrolyte composition of 15 grams per liter of zinc oxide in a 2M solution of potassium hydroxide, a nickel rod anode of approximately 2 sq.cm. immersed area anodized for 45 minutes in the electrolyte was lowered into a fluidized bed of zinc-coated copper beads of about 500 m diameter, without the anodizing current being switched off. There was no observable evidence that any electrochemical reaction was occurring and copious gas was evolved from the anode region when the current was zero but this evolution ceased when the current had increased to about 0.3 amps; no further gas evolution was observed as the current was increased still further. At 3.0 amps. the cell voltage was 2.5 volts but no gas was evolved.

This test shows that the zinc was being spontaneously dissolved at the low current and that hydrogen was probably being evolved from the nickel.

X. When the test of IX was repeated using a nickel anode pretreated in nickel acetate solution to form a visible black oxide coating on its surface, no gas evolution occurred on entry into the fluidized bed of particles but did occur from the anode region as the current was increased.

XI. As for X but the zinc-coated copper beads were replaced by uncoated copper beads and the cell operated at a current of 0.5 amps. The copper beads rapidly became coated with zinc, this indicating that, in spite of the presence of an anode dipped into the bed, a cathodic reaction could still proceed; at the same time gas evolved from the region of the anode.

XII. As for X but using a D.S.A. type anode the following results were obtained with the cell:

| Current amps | 0 | 0.2 | 0.5 | 1.5 | 2 | 3 |
|---|---|---|---|---|---|---|
| Feeder-Anode Voltage/volts | 0.18 | 2.0 | 2.2 | 3.0 | 3.5 | 4.3 |

No gas evolution was observed at zero current but at a current of 0.2 amp or higher gas was observed to be evolved in the region of the anode.

XIII. A manganese dioxide coated nickel rod of approximately 2 sq.cm. immersed area was used with the cell similar to that used in test X; an electrochemical reaction was sustained for a while but this oxide material is soluble in alkali.

XIV. A lead dioxide coated lead anode worked for a short time and probably could have been made capable of longer performance.

XV. Using the same cell but with a lead dioxide coated lead anode in a zinc sulphate electrolyte containing approximately 140 grams per liter of zinc and using a fluidized bed of uncoated copper beads, the beads rapidly became coated with zinc when the anode was dipped into the bed, with the following results in sequence of increasing time:

| Current amps | 1.0 | 2.0 | 2.4 | 2.4 | 2.4 | 2.4 |
|---|---|---|---|---|---|---|
| Feeder-Anode Voltage/volts | 4.7 | 5.8 | 5.5 | 5.0 | 4.7 | 4.6 |

A further test made use of a mild steel electrode which had been anodized overnight in ferric sulphate solution containing 30 g.p.l. $Fe^{3+}$ to form a complete light brown coating of oxide. Using this iron oxide as anode by immersing the electrode in the particles of a circulating bed type of cathode, this cell was effective in stripping a zinc solution from 1.5 g.p.l. to 0.8 g.p.l. of zinc at a current density of 2000 amps. per $m^2$., and cell voltage of 2.9 volts and a current efficiency of 67 percent was achieved.

It will be appreciated that the invention leads to considerable simplification of cell design, particularly in the electro-deposition field and it seems that it is possible to run particulate electrodes in alkaline as well as in acid solutions by direct insertion of a suitable counter electrode.

Although no examples have been given, it should be understood that cells using particulate electrodes and directly inserted counter electrodes in accordance with the invention may be used in general synthesizing applications; provided, of course, that the product does not react at the counter electrode.

We claim:

1. An electrochemical cell comprising a particulate electrode having a current feeder member and a mass of particles, the particles having surfaces at least some of which are electronically conductive, means for passing an electrolyte through said particulate electrode such as to expand the mass of particles at least into a fluidized bed in contact with said current feeder member and a counterelectrode in direct contact with at least some particles of said particulate electrode, the material of the surface at least of said counterelectrode being electrically conducting, but the contact resistance in air between a surface of said material and the superficial area of a copper test surface being at least about 10 times the contact resistance under the same conditions of measurement between the said area of said copper test surface and another surface of copper.

2. An electrowinning reaction using an electrochemical cell as claimed in claim 1.

3. An electrochemical synthesizing reaction using an electrochemical cell as claimed in claim 1.

4. An electrochemical cell as claimed in claim 1, wherein the surface of said counterelectrode is graphite.

5. An electrochemical cell comprising a particulate electrode having a current feeder member and a mass of particles in contact with said current feeder member, the particles having surfaces at least some of which are electronically conductive, means for passing an electrolyte through said particulate electrode and a counterelectrode, in direct contact with at least some particles of said particulate electrode, the material of the surface at least of the counterelectrode being an electrically conducting oxide material whose contact resistance in air between a surface of said oxide material and the superficial area of a copper test surface is at least 10 times the contact resistance under the same conditions of measurement between said area of said copper test surface and another surface of copper.

6. An electrochemical cell as claimed in claim 5, wherein the said surface is ruthenium oxide.

7. An electrochemical cell as claimed in claim 6, wherein said surface is carried by a titanium base.

8. An electrochemical cell as claimed in claim 5, wherein the surface of said counterelectrode is iron oxide.

9. An electrochemical cell as claimed in claim 5, wherein said surface of the counterelectrode is lead oxide.

10. An electrochemical cell as claimed in claim 9, wherein said surface of lead oxide is carried by a base of lead.

11. An electrochemical cell as claimed in claim 9, wherein said surface of lead oxide is carried by a base of steel.

* * * * *